US007845611B1

(12) United States Patent
Sholander

(10) Patent No.: US 7,845,611 B1
(45) Date of Patent: Dec. 7, 2010

(54) DOOR OPERATED PAGE TURNER DEVICE, SYSTEM AND METHOD FOR BOOKS

(76) Inventor: Alfred M. Sholander, 1279 Pilgrim Pl., Daytona Beach, FL (US) 32119

( * ) Notice: Subject to any disclaimer, the term of this patent is extended or adjusted under 35 U.S.C. 154(b) by 599 days.

(21) Appl. No.: 11/941,348

(22) Filed: Nov. 16, 2007

(51) Int. Cl.
*A47B 5/04* (2006.01)

(52) U.S. Cl. ..... 248/444.1; 248/441.1; 248/449; 248/450; 248/451; 40/343; 40/356

(58) Field of Classification Search ..... 248/441.1, 248/444.1, 449, 450, 451; 40/342, 343, 356
See application file for complete search history.

(56) References Cited

U.S. PATENT DOCUMENTS

| | | | | |
|---|---|---|---|---|
| 1,261,362 | A * | 4/1918 | Cook | 248/444.1 |
| 1,953,560 | A | 4/1934 | Valsie | |
| 3,128,573 | A | 4/1964 | Cook et al. | |
| 3,809,352 | A * | 5/1974 | Mathias | 248/444.1 |
| 3,943,018 | A | 3/1976 | Petry et al. | |
| 4,275,863 | A | 6/1981 | Hartman | |
| 4,467,991 | A | 8/1984 | Bailes | |
| 4,587,149 | A | 5/1986 | Murachi | |
| 4,644,675 | A | 2/1987 | Berger et al. | |
| 4,685,374 | A | 8/1987 | Goldner | |
| 4,767,094 | A | 8/1988 | Brown | |
| 4,882,969 | A | 11/1989 | Ricca | |

(Continued)

OTHER PUBLICATIONS

Assistive Devices for Reading' Reference Circular, National Library Service for the Blind and Physically Hindicapped, Library of Congree, Washington, DC 20542, [online], Sep. 1993, No. 93-02, 5 pages [retrieved on Oct. 19, 2005]. Retrieved from Internet, http://www.makoa.org/gov/assistiv.htm.

*Primary Examiner*—Terrell Mckinnon
*Assistant Examiner*—Michael McDuffie
(74) *Attorney, Agent, or Firm*—Brian S. Steinberger; Law Offices of Brian S. Steinberger, P.A.

(57) ABSTRACT

Door/lid operated page turner devices, systems and methods for reading materials such as books is provided for hands-free reading for the able-bodied and disabled reader. A platform supports a book that is covered by a bottomless box having an open top, with left and right transparent lids slidably attached to cover the open top with a small space between the lids when closed. A single protruding member with a tip is adapted to slide the right transparent lid to the right exposing a page of the stacked reading pages, the tip is also used to lift up an outer edge of the page to be above the right transparent lid, followed by the tip of the protruding member pushing against and sliding the right transparent lid to the left until the right transparent lid abuts against the spacer, wherein the tip of the protruding member pushes both the closed left and right transparent lids to the left until the raised first page is turned and overlaying the left portion of the supporting platform. The user slides the closed pair of transparent lids back to align the spacer gap between the doors with the center of the book thereby fixing the turned page into a new position. Protruding members such as a nose can move the lids, and pursed lips can move pages with the device. Additionally, other protruding members such as pencils can be used.

31 Claims, 17 Drawing Sheets

U.S. PATENT DOCUMENTS 5,149,046 A * 9/1992 Kerley et al. ..... 248/453
5,634,623 A 6/1997 Hoijitnk
5,810,316 A * 9/1998 Eby ..... 248/451
5,979,857 A 11/1999 Holm
6,220,559 B1 * 4/2001 Chow ..... 248/445
6,234,441 B1 5/2001 Gordon
6,286,841 B1 9/2001 Foy et al.
D452,276 S 12/2001 Hurwitz
7,240,887 B2 * 7/2007 Buote ..... 248/447
7,374,143 B1 * 5/2008 Wittke ..... 248/444.1
7,731,147 B2 * 6/2010 Rha ..... 248/447
2001/0010351 A1 8/2001 Schutze
2001/0023916 A1 * 9/2001 Armstrong ..... 248/447.1

* cited by examiner

DOOR OPERATED PAGE TURNER DEVICE, SYSTEM AND METHOD FOR BOOKS

FIELD OF THE INVENTION

The present invention relates to reading aids for individuals with upper extremity disabilities, arthritis, or other conditions that require hands-free reading and more particularly to devices, systems and methods for turning the pages of reading material such as books.

BACKGROUND AND PRIOR ART

It is well-known to use an eraser tip of a pencil or hand-held erasers or rubber thimble type finger covers for turning pages of reading material, counting money and otherwise handling papers to be moved individually. However, this does not solve the problem of holding a book or volume when the person is disabled or needs to have his or her hands-free when referencing manuals, technical literature and the like.

In reference circular No. 93-02 entitled, *Assistive Devices for Reading* published online (http:www.makoa.org/gov/assistiv.htm) by the National Library Service for the Blind and Physically Handicapped, Library of Congress, Washington, D.C. 20542 (September 1993), pages 1-5 provide a comprehensive list of Book Holders and Book Stands, and on pages 27-28, a list of commercially available "Page Turners" is provided. Among the page turning devices disclosed in *Assistive Devices for Reading* there is a range from complex, such as, those operated with a pneumatic switch, pedal controls, joysticks to very simple devices, including tapered strips with foam-rubber tips and rubber friction tips on a wooden dowel.

A number of prior art inventions have been made which provide means for holding, supporting and/or turning the pages of reading material, such as books, but such prior art devices are usually costly and complicated. Several prior art inventions are described briefly in the following summaries.

U.S. Pat. No. 4,467,991 to Bailes discloses an armchair reading stand having a pair of rails coextensive with and slidably connected to the undersurface of the book support panel in tongue and groove fashion.

U.S. Pat. No. 4,644,675 to Berger et al. illustrates a page turning device having a support for the book and power driven rotating disc which turns the pages.

U.S. Pat. No. 4,685,374 to Goldner illustrates a page turning device having a rotatable elongated arm that uses a circular motion to turn pages.

U.S. Pat. No. 4,882,969 to Ricca illustrates a page turning device whereby after a book is secured, a plurality of rotatable rods are activated to turn a page by using a foot-operated pedal.

U.S. Pat. No. 5,149,046 to Kerley et al. describes a page turning system having a pair of rectangular frames connected to one another by a hinge to vary the inclination of the reading materials and a pair of bent spring mounted wires for holding opposing pages of the reading material open for reading and a variable friction adjustment to enable the force of the wires against the pages to be varied while permitting manipulation of pages by a stick employed by the reader.

U.S. Pat. No. 5,634,623 to Hoijtink describes a device for holding a publication such as a book or magazine between two L-shaped supports with a brush-like surface that are slidable relative to each other and adapted to accommodate a publication between them.

U.S. Pat. No. 5,979,857 to Holm describes an adjustable book holder which can be attached to a stand to permit hands-free reading and hand assisted page turning in a sitting or reclining position; pages are held open with a monofilament line.

U.S. Pat. No. 6,234,441 B1 to Gordon describes a bookstand with a base adapted to fit under a person's leg and a pivotal arm connected to the base to hold the book support or platform; a page retainer extends across the opposing opened pages.

U.S. Publication No. 2001/0010351 to Schutze illustrates a book holding device having an adjustable support plate.

U.S. Publication No. 2001/0023916 to Armstrong illustrates another book display apparatus having a transparent front section made from Plexiglas.

None of the prior art references provides an inexpensive, easy to operate, multiple use book holder and door-operated page turning device combination that holds a page open with no obstruction of view and accommodates a wide variety of reading materials, including but not limited to, hard-covered books, paperbacks, magazines, catalogs, bound papers, sheet music and the like. The present invention provides such a device.

SUMMARY OF THE INVENTION

It is a primary objective of the present invention to provide door-operated page turner devices, systems and methods for holding a book and its pages in a steady position for hands-free reading.

A second objective of the present invention is to provide door-operated page turner devices, systems and methods for the disabled and for those who must refer to the reading material preferably without touching it with their hands, such as cooks, mechanics, and musicians.

A third objective of the present invention is to provide door-operated page turner devices, systems and methods for printed materials which is similar to and as simple as an eraser-tipped pencil.

A fourth objective of the present invention is to provide door-operated page turner devices, systems and methods that can be easily fabricated in a variety of sizes to accommodate hard-covered books, paperbacks, magazines, catalogs, bound papers, sheet music and the like.

A fifth objective of the present invention is to provide low-cost page turner devices, systems and methods that does not create a fire or safety hazard by avoiding electrical, electronic, pneumatic, hydraulic, or mechanical rotating or reciprocating components, making it safe to be used even in bed where the reader may fall asleep.

A sixth objective of the present invention is to provide door-operated page turner devices, systems and methods on a basic platform or case that accommodates a large variety of reading material ranging from standard size and oversize books, to magazines and small pocket books.

The present invention is a door-operated page turner or reading aid for able-bodied and disabled persons unable to use or preferring not to use his or her hands. The door-operated page turner device includes a platform that supports a plurality of transparent doors that open and close and are used for turning and holding the pages of reading material in a fixed open position while providing an unobstructed view of the page.

The pages of the reading material can be turned with a low-cost tool similar to an eraser-tipped pencil. Once disengaged, a page pops up enough to allow the reader to use the plurality of doors to turn that page to its new position. For the disabled person who is lacking manual dexterity, the tool can be readily adapted to the existing gripping prosthetic devices suitable for that disability. Once turned, the page or pages are held in place by a plurality of transparent doors that cover the compartment that holds stacked reading pages in a fixed open position.

A preferred page turning system for hands-free reading of books includes a box having an open top, sides and a bottom, a left transparent lid being slidably attached to cover a left portion of the open top, a right transparent lid being slidably attached to cover a right portion of the open top, a spacer for keeping the left transparent lid and the right transparent lid spaced apart less than approximately 0.5 inch when the left transparent lid and the right transparent lid are in a closed position covering the open top of the box, a reading material having a front cover, a back cover and a plurality of stacked reading pages between the front and back covers, the bottom of the box supporting the reading material in an open position with the front cover overlaying a left portion of the bottom of the box, and the back cover with the plurality of stacked reading pages overlaying a right portion of the bottom of the box, a single protruding member with a tip, wherein the tip of the protruding member is adapted to slide the right transparent lid to the right exposing a first page of the stacked reading pages, and the tip is used to lift up an outer edge of the first page to be above the right transparent lid, followed by the tip of the protruding member pushing against and sliding the right transparent lid to slide to the left until the right transparent lid abuts against the spacer, wherein the tip of the protruding member pushes both the closed left and right transparent lids to the left until the raised first page is overlaying the left portion of the bottom of the box.

A more preferred page turning system has a spacer that allows for keeping the left transparent lid and the right transparent lid spaced apart approximately ⅛ of an inch when the left transparent lid and the right transparent lid are in a closed position covering the open top of the box. It is also preferred that at least one of the left transparent lid and the right transparent lid has a beveled edge that abuts against the spacer. Most preferably, the right transparent lid has a beveled edge that abuts against the spacer.

The preferred page turning system of the present invention also includes a left set of tracks for slidably attaching the left transparent lid to the open top of the box and a right set of tracks for slidably attaching the right transparent lid to the open top of the box.

It is also preferred that the page turning system include height adjustment members for adjusting distance between the left and right transparent lids to the bottom of the box. In addition, it is preferred to have height adjustment members on the left lower sides and right lower sides attached to the bottom of the box which slide about the sides of the box and openings at different heights along the left lower sides and the right lower sides and dowels for being inserted in the different height openings for separating the left and right transparent lids from the bottom of the box for different sizes of reading materials. The height adjustment members for use with reading materials such as books, magazines, and the like, having different thicknesses.

The preferred reading material for the page turning system of the present invention is a magazine or a book. The preferred protruding member with the tip for the page turning system is a pencil with an eraser tip or the tip is adapted to be a human nose or a human finger.

A preferred method for turning pages in a bound volume so that reading is accomplished hands-free includes providing a reading material with a front cover, a back cover and a stack of reading pages between the front and back cover, providing a box having an open top, closed sides and a platform as a bottom of the box, providing a single protruding member with a tip, then opening the reading material so that the front cover is supported on a left portion of the platform and the back cover with the stack of reading pages is supported on a right portion of the platform, slidably covering a left portion of the open top of the box with a left transparent lid, slidably covering a right portion of the open top of the box with a right transparent lid.

The method can include spacing the left transparent lid apart from the right transparent lid so that an opening is no greater than approximately 0.5 inch (preferably approximately ⅛ of an inch) when the left transparent lid and the right transparent lid are in a starting closed position on the top of the box, pressing the tip of the protruding member against a portion of the right transparent lid, slidably moving the right transparent lid to the right with the tip of the protruding member exposing a first page of the stacked reading pages, raising an outer exposed edge of the first page of the stacked reading pages with the tip of the protruding member, allowing the outer exposed edge of the first page to protrude above and come to rest against a portion of the right transparent lid, slidably moving the right transparent lid to the left with the tip of the protruding member until the left transparent lid and the right transparent lid are in a closed position with the first page of the stacked reading pages sandwiched in the opening between the right transparent lid and the left transparent lid.

The method can include continuing the movement of the right transparent lid to the left until the first page slips through the opening between the closed right transparent lid and left transparent lid and the raised first page is overlaying the left portion of the bottom of the box, slidably returning both the closed left and right transparent lids with an opening no greater than approximately 0.5 inch (preferably approximately ⅛ of an inch) to the starting closed position on the top of the box, and repeating the above steps to expose each additional stacked page.

The preferred reading material in the method for turning pages is a magazine or a book. The preferred single protruding member with the tip used in the method for turning pages is a pencil with an eraser tip or is a tip adapted to be a human nose or a human finger. Additionally, the reader can use their pursed lips to move the lids and/or the pages.

Further objects and advantages of this invention will be apparent from the following detailed description of the presently preferred embodiments, which are illustrated schematically in the accompanying drawings.

DESCRIPTION OF THE PREFERRED EMBODIMENTS

Before explaining the disclosed embodiments of the present invention in detail, it is to be understood that the invention is not limited in its application to the details of the particular arrangements shown since the invention is capable of further embodiments. Also, the terminology used herein is for the purpose of description and not of limitation.

In the description of the present invention, the term "book" or "books" will represent all reading matter, including magazines, atlases, brochures, catalogs, manuals, manuscripts and any other matter being examined visually.

Other terms used herein are defined as follows.

"Binding" to mean the spine, cover and end papers of a bound volume.

"Gutter" is the white space formed in the inner margins of two facing pages of a bound publication.

"Paperback" is a book bound in a flexible, paper cover.

"Platform" is a square or rectangular, three-dimensional, open-face case for supporting an open book in a generally upright angled orientation.

"Spine" is the hinged back of a book.

Figure 18:
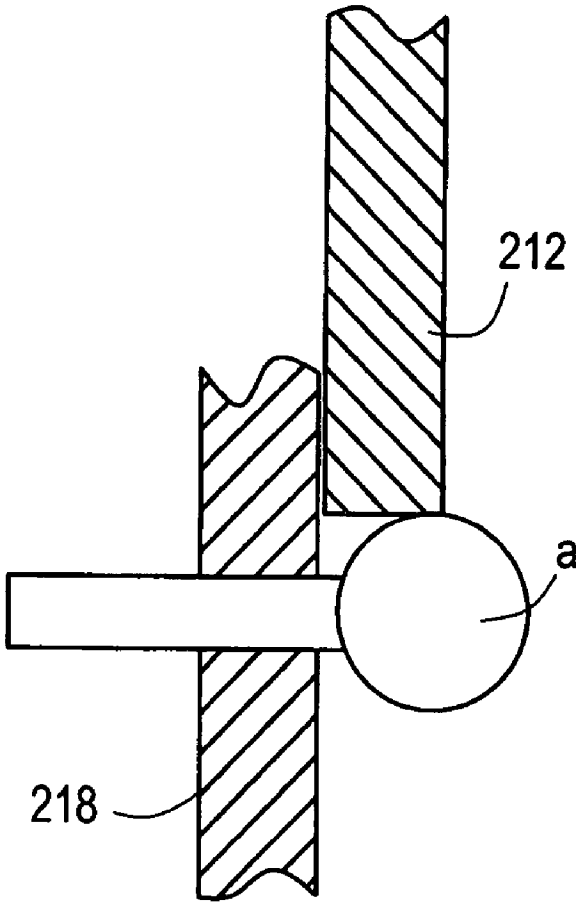
FIG. 18 shows an enlarged side view of the height adjusting knobs of the second embodiment.

A listing of the components will now be described.

a, b left knobs
a', b' right knobs
c upper groove
d bottom groove
e dowel insert
f dowel insert
12 bottomless box with sides
14 right transparent lid
16 left transparent lid
18 platform with downward extending sides
20 book
20*a* first page of book
20*b* back of first page of book
22 spacer gap
24 decorative trim to form spacer gap
30 spring loaded clip/clamp to hold down back cover
32 probe with tip/finger/nose
100 first embodiment of page turning device
200 second embodiment of page turning device
212 box with sides
218 platform
214 right transparent lid
216 left transparent lid
232 probe with tip/finger/nose
240 left wing extension
250 right wing extension
260 optional openings in left lid
270 optional openings in right lid Embodiment 1 of the present invention 100 is described in FIGS. 1-10 and 17. Embodiment 2 of the present invention 200 is described in FIGS. 11-16 and 18. The common features for all embodiments include the platform or case for supporting an open book in a generally upright angled orientation and the base stands or props to hold the platform or case in an angled orientation. The slidably removable dowel support rods that support the open box top of each embodiment above the platform that holds the reading material are shown in FIGS. 18 and 19. A person skilled in the art can readily devise additional embodiments by interchanging and rearranging the elements disclosed herein. Therefore, the embodiments disclosed are not to be considered a limitation of the present invention.

Figure 1:
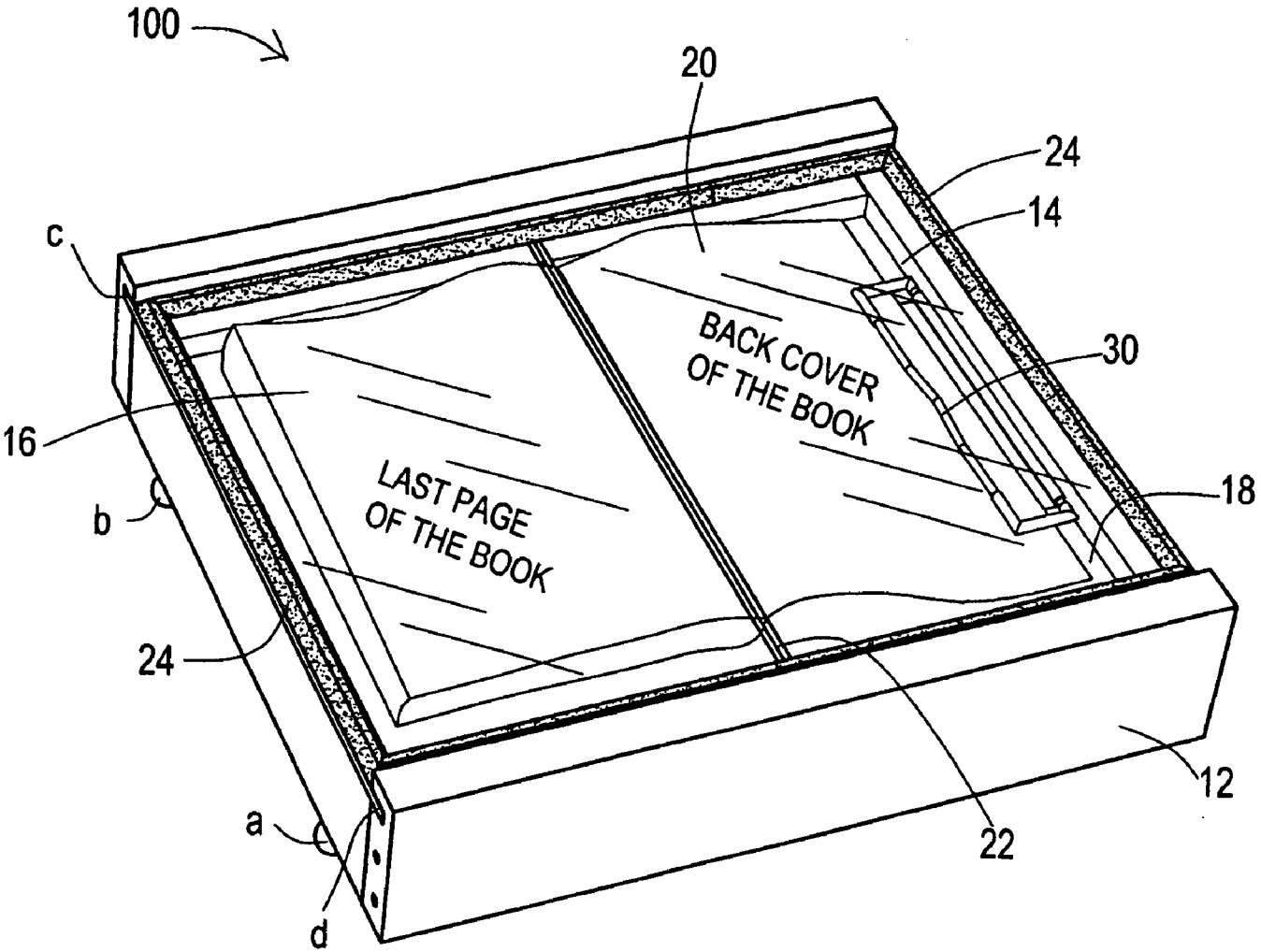
FIG. 1 is a front perspective view of a first embodiment of the novel page turner device with book opened inside and back cover clamped in place.

FIG. 1 shows a front perspective view of the door-operated page turning device 100 having a bottomless box 12 with four sides resting on dowel rods with knobs a, b along the right side edges of box 12. A right transparent lid or door 14 and a left transparent lid or door 16 are in a closed position in the tongue and groove channels c, d in the upper and lower sides of the box 12. The terms "lid" and "door" are used interchangeably herein to mean the portion of the present device that opens and closes while turning pages of reading material. The bottomless box with sides 12 covers a platform 18 that holds or supports an open book. Platform 18 has holes for the insertion of the dowel rods with knobs a, b. A spacer gap 22 of less than approximately 0.5 inch (preferably approximately ⅛ of an inch) is between the left transparent lid and the right transparent lid in the closed position to facilitate the opening and closing of the transparent lid when the lids are used to turn a page of a book 20.

FIG. 1 also shows an optional decorative trim 24 around the outer edges of the transparent right and left lids 14, 16. The decorative trim 24 is useful in providing a raised surface for leverage in slidably moving the lids and creating the spacer gap 22. The trim is useful to let the lids move more smoothly on the surface of the box than the lids moving relative to the grooves. The left lid has trim portions that extend to the right to contact the right lid, so that when the right and lid trim portions meet together, they create the space gap therebetween. The trim is also raised and is further useful for the reader to move the lids. The trim also can add a bit of decoration to cover the plain edges of the box lids.

FIG. 1 shows an initial position of opening a book 20 on platform so that the back cover is clamped in place by clamp 30 of the right side of the platform with front cover and all the pages are on the left side of the platform.

Figure 2:
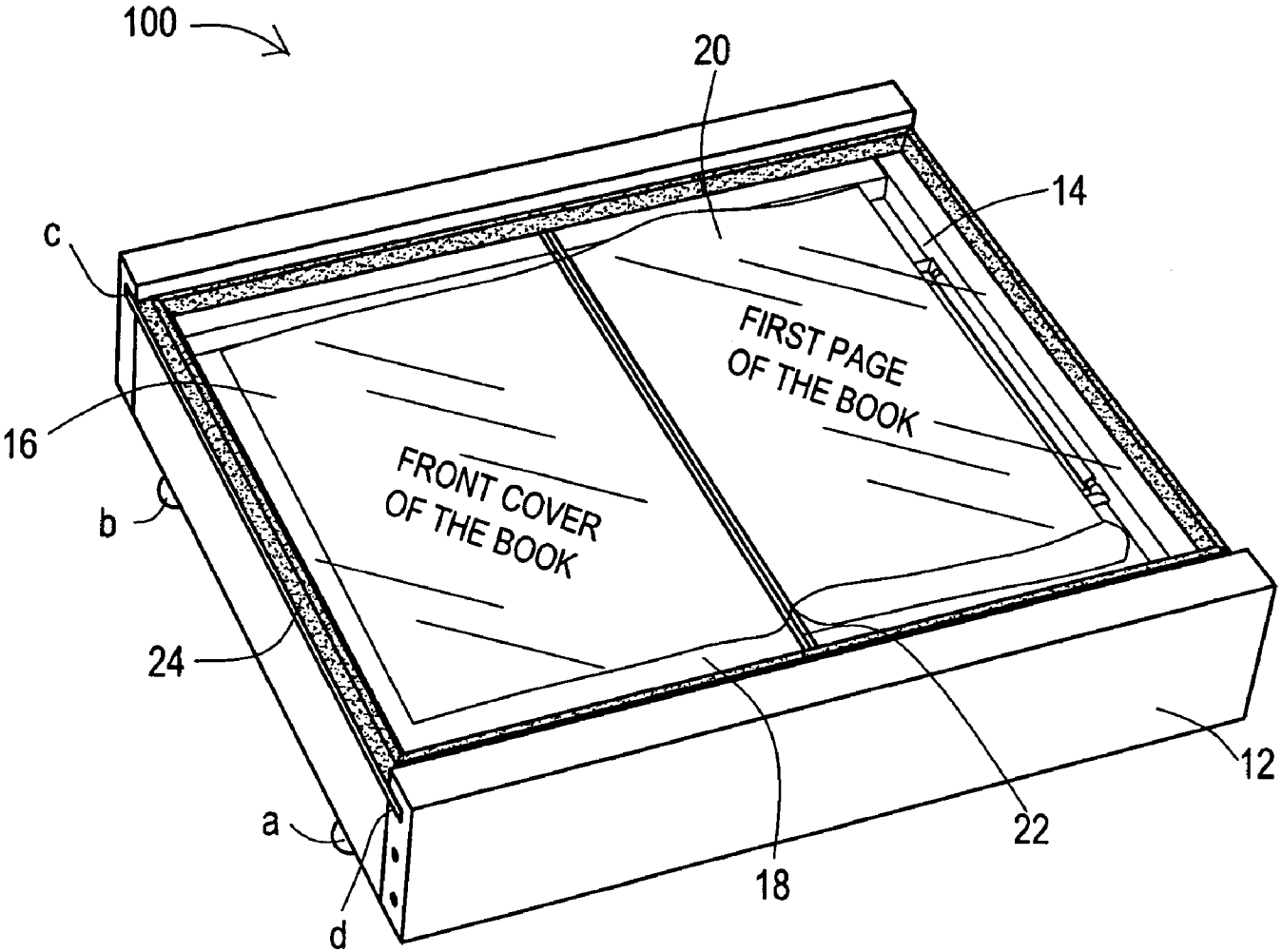
FIG. 2 is a front perspective view of the novel page turner device of FIG. 1 with book opened inside and all pages moved over clamped back cover except for the front cover.

In FIG. 2, all the stacked pages are moved to the right over the clamped back cover so that only the front cover of the book 20 is on the left side of the platform 18.

Figure 3:
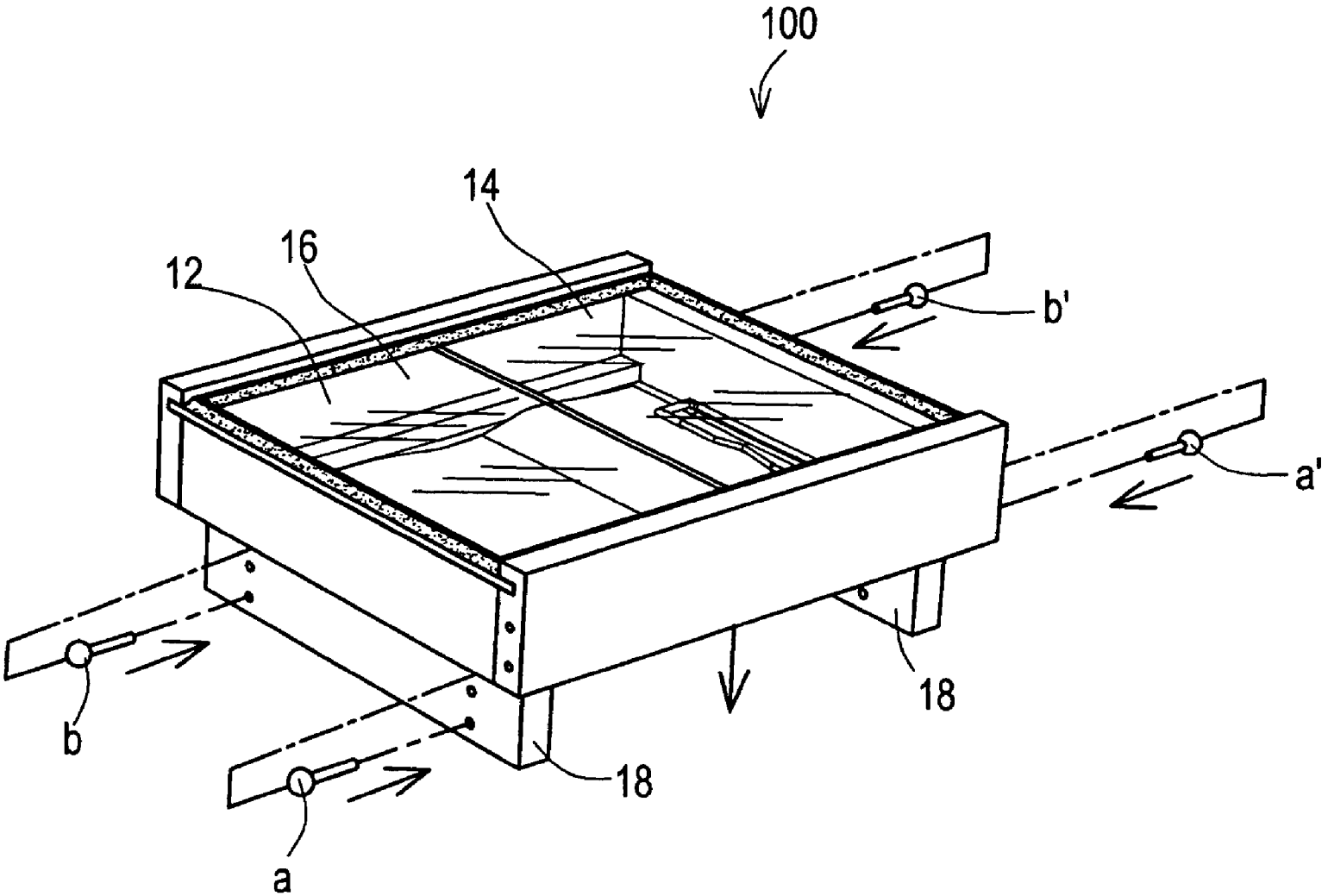
FIG. 3 is another perspective view of the page turner device of FIG. 1 with height setting knobs.

FIG. 3 is a partially exploded front perspective view of the door-operated page turning device 100 showing the supporting legs of platform 18 with symmetrically aligned and vertically positioned holes to adjust the height of the bottomless box 12 using dowel rods with knobs a, b on the left side and dowel rods with knobs a', b' on the right side of platform 18.

Figure 4:
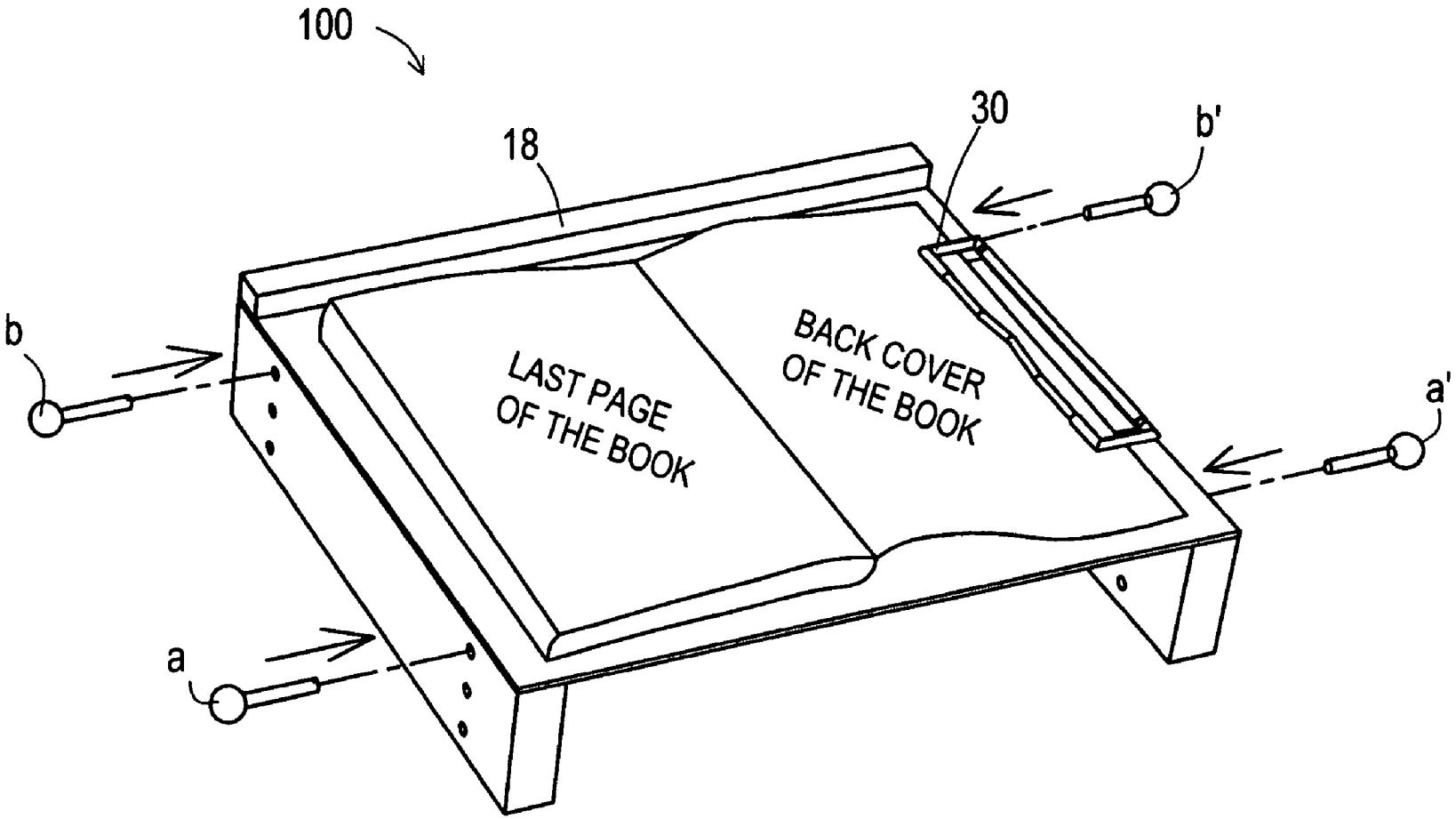
FIG. 4 is another perspective view of the platform with attached open book separated from the outer box of the page turner device of FIG. 1.

FIG. 4 is a front perspective view of the platform 18 of the door-operated page turning device 100 showing flat surface of the platform 18 with a clamp 30 to hold a back cover of the book 20 securely in place and the slidably removable dowel rods with knobs a, a', b, b' that can be adjusted to raise or lower the door-operated page turning device on the bottomless box 12.

Figure 5:
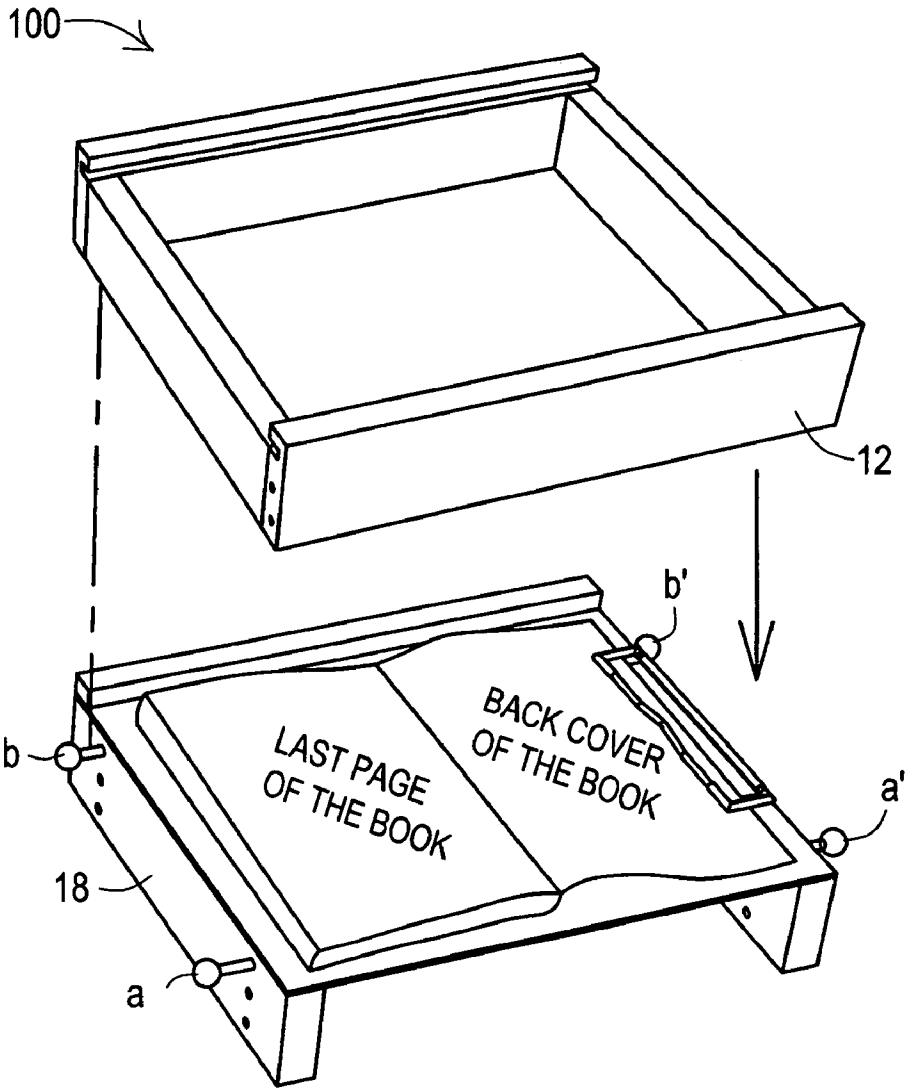
FIG. 5 is an exploded view of the platform with attached book and box of the preceding figures.

FIG. 5 is a partially exploded front perspective view of the door-operated page turning device 100 with bottomless box 12 in position to be lowered onto platform 18 with dowel rods a, a', b, b' in the holes in a first position.

Figure 6:
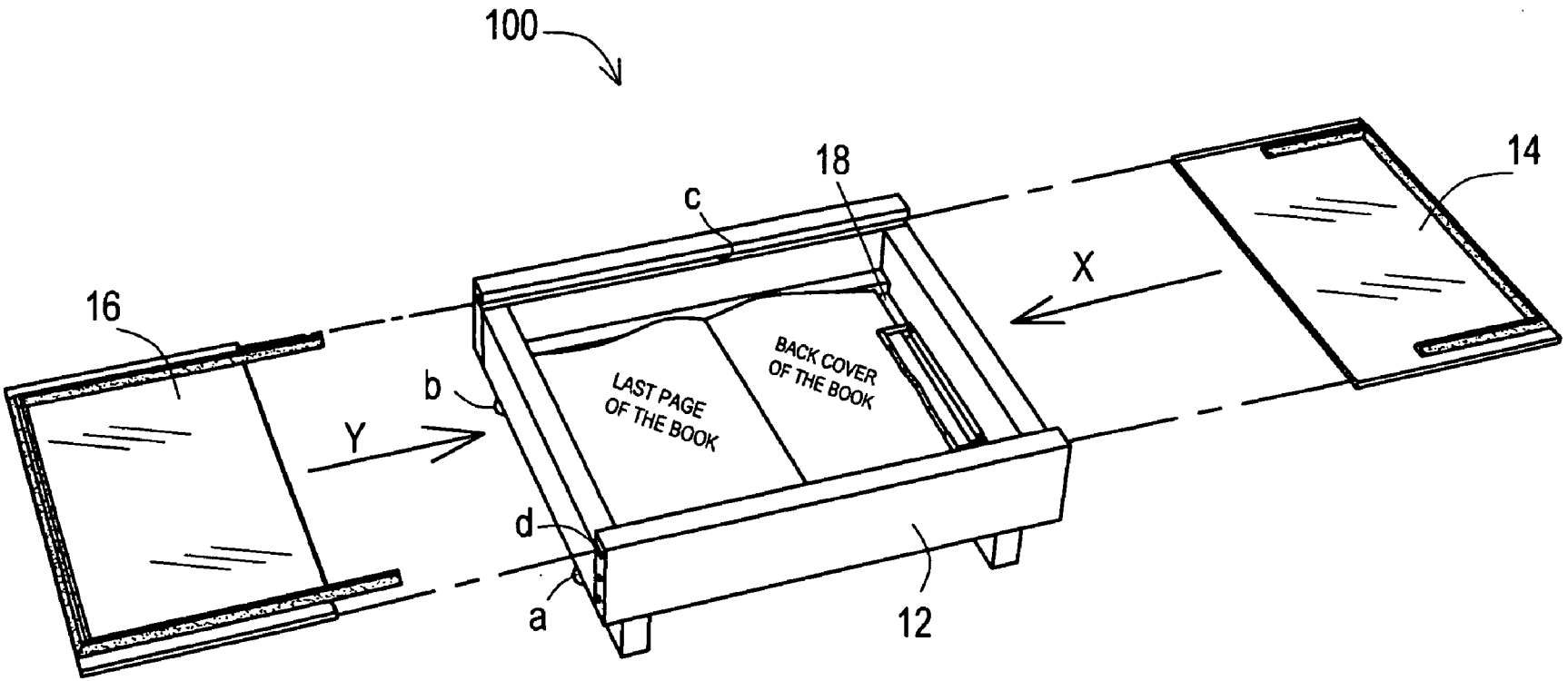
FIG. 6 is a perspective view of the box and platform with attached book with right and left transparent lids separated from the box.

FIG. 6 is a plan view of the door-operated page turning device 100 when the bottomless box 12 is positioned over platform 18, resting on dowel rods with knobs a, b (a',b' not shown). The right transparent lid 14 and left transparent lid 16, are in the process of being aligned to be slidably moved along the tongue and groove channels c, d of box 12 in the direction of arrows X and Y, respectively.

FIGS. 7-19 show the door-operated page turning device 100 being used to turn pages of an open book supported on the flat surface of platform 18.

Figure 7:
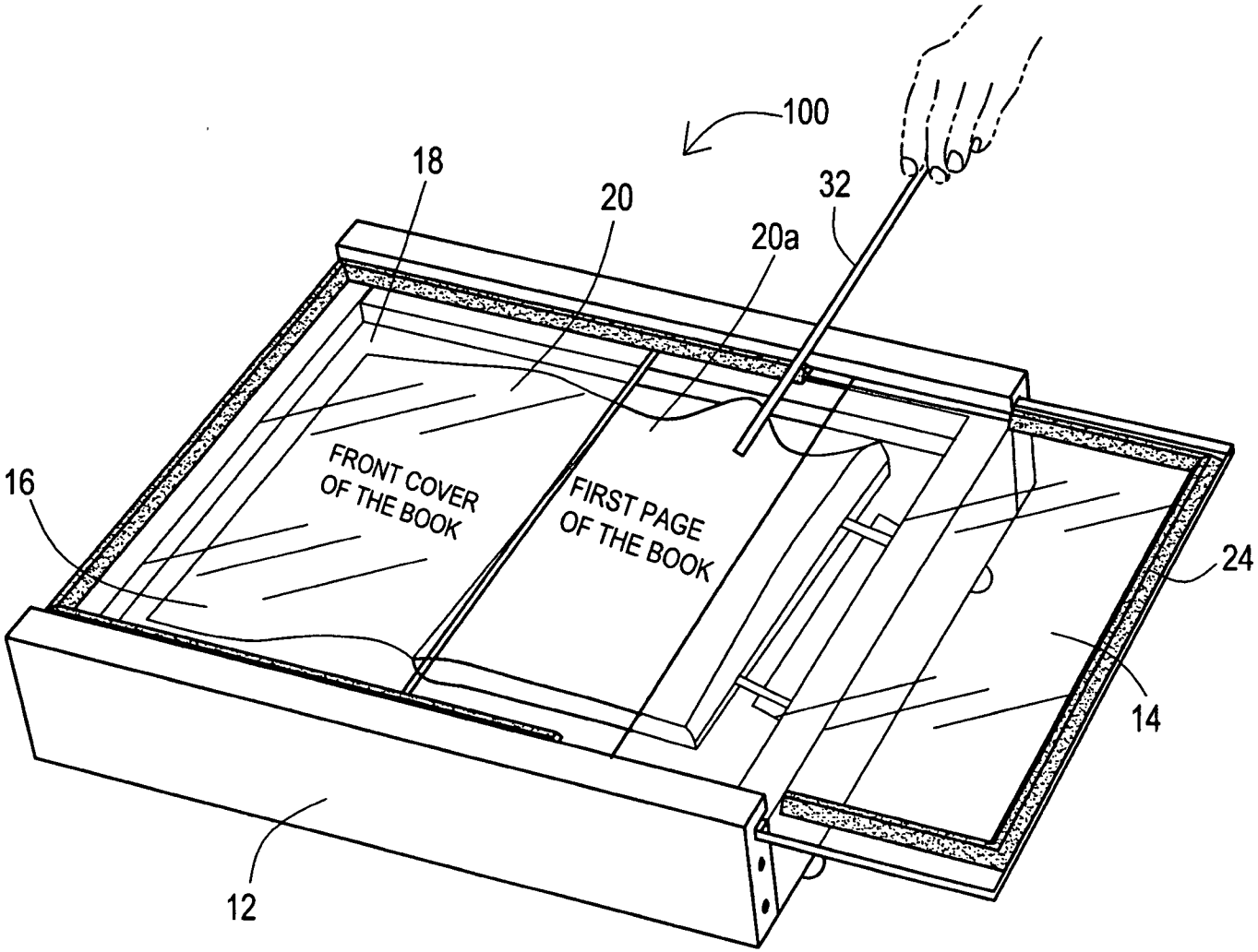
FIG. 7 shows a first page edge of the platform attached book in the box of the preceding figures, being lifted and raised over the left edge of the right transparent lid.

FIG. 7 shows the left transparent lid 16 of the door-operated page turning device 100 in alignment with the left edge of box 12. The right transparent lid 14 of the door-operated page turning device is slidably moved to the right to partially expose a first page 20*a* of book 20. A probe or any protruding member with a tip 32 is used to lift or raise an outer edge of first page 20*a* from the stack of pages in book 20. By only partially exposing the first page, the rest of the stacked pages are not prone to easily flip up. The probe can include a pencil with eraser tip, a stick, and the like. Furthermore, a body part such as but not limited to a finger or a nose can also be used. Still furthermore, pursed lips can be used to move the lids and/or to move the pages.

Figure 8:
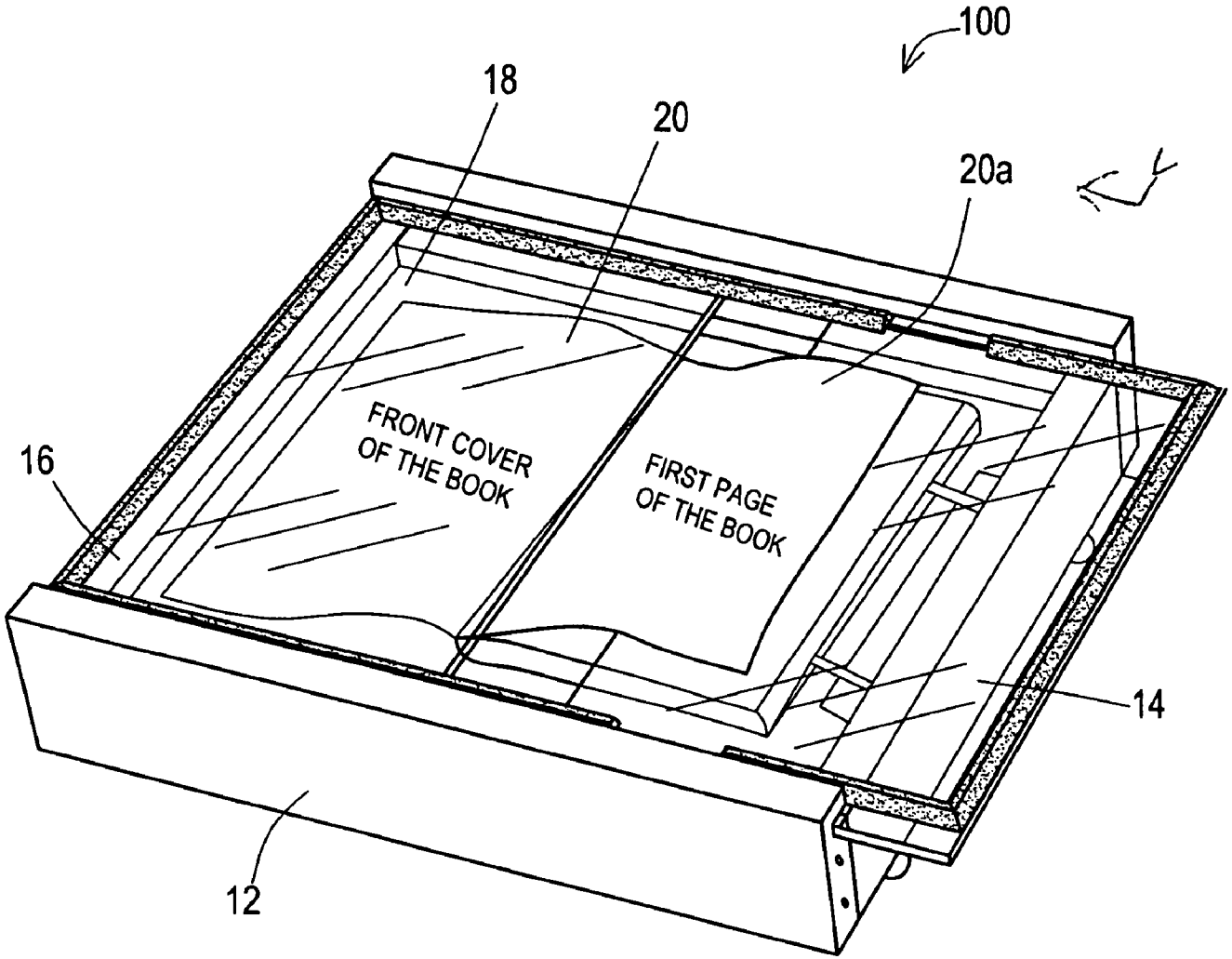
FIG. 8 shows another view of the page turning device of FIG. 7 with the right lid being moved to the left along arrow Y to catch under the first page of platform attached book.

The next step for turning a page using the door-operated page turning device is shown in FIG. 8 where probe or protruding member with a tip 32 is used to guide the outer edge of page 20*a* onto the outer surface of the right transparent lid 14, as lid 14 is slidably moved toward the left transparent lid 16 capturing the page in the spacer gap 22. Here, upper and lower right protruding trim portions of trim 24 on the left lid 14 extend to the right to allow for capturing and aligning each additional page being raised and lifted.

Figure 9:
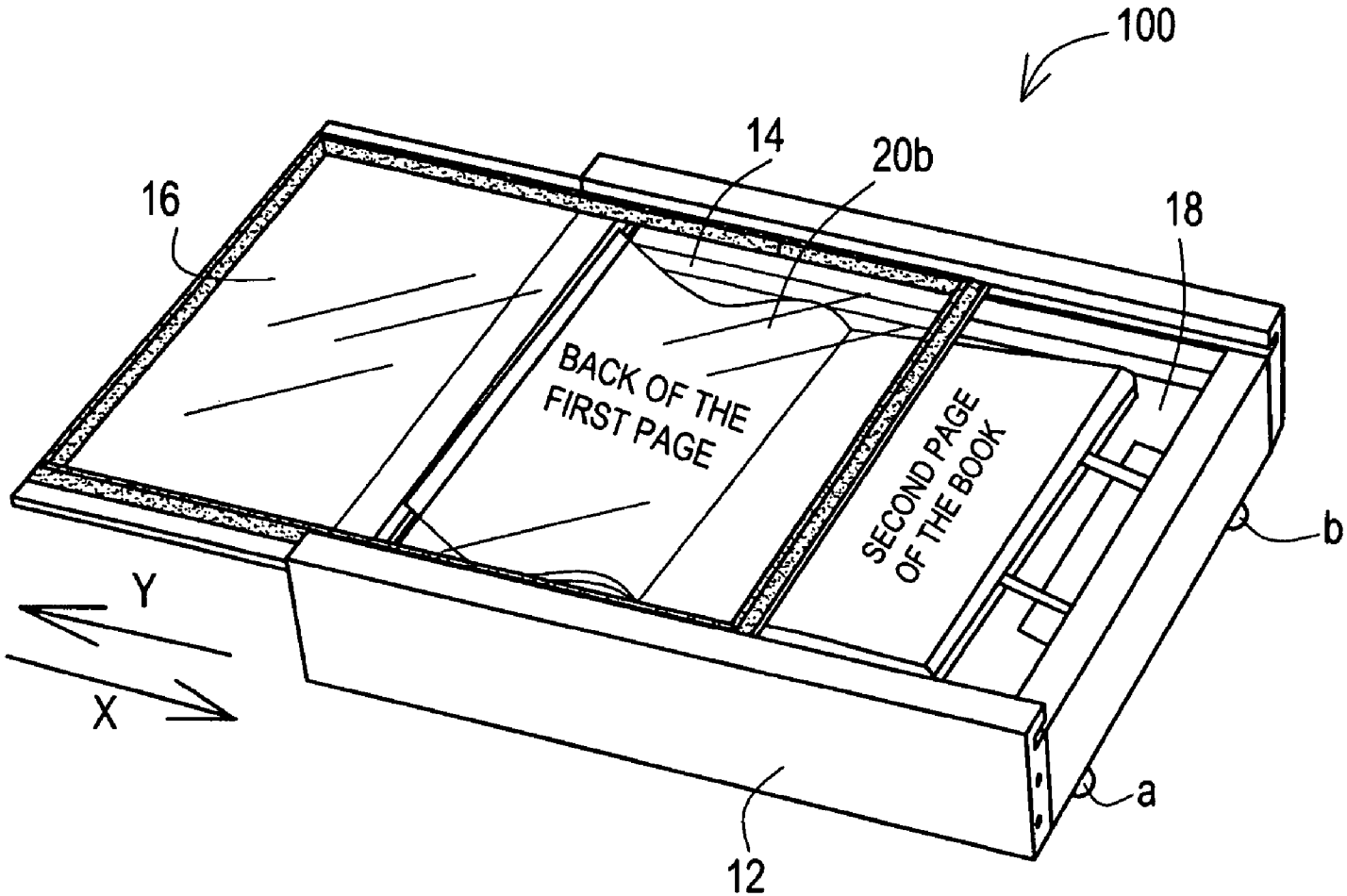
FIG. 9 shows both the left lid and right lid moving in unison to the left along arrow Y, of the page turning device of FIG. 8 with the first page moving from the right side of the box to the left side of the box by slipping through the gap between the left and right transparent lids.

FIG. 9 shows the spacer gap 22 with the page 20*a* sandwiched between the left and right transparent lids and being turned to expose the second page 20*b* of book 20 on the right side of platform 18 while first page moves to a new position overlaying the left side of the flat surface of platform 18. Here, the back page 20*b* of the first page of the book is now on the left side of the platform. In FIG. 9, the left and right lids 14, 16 can be moved to the left along arrow Y with the previous probe 32 abutting against a top or right edge of the right lid 16.

Figure 10:
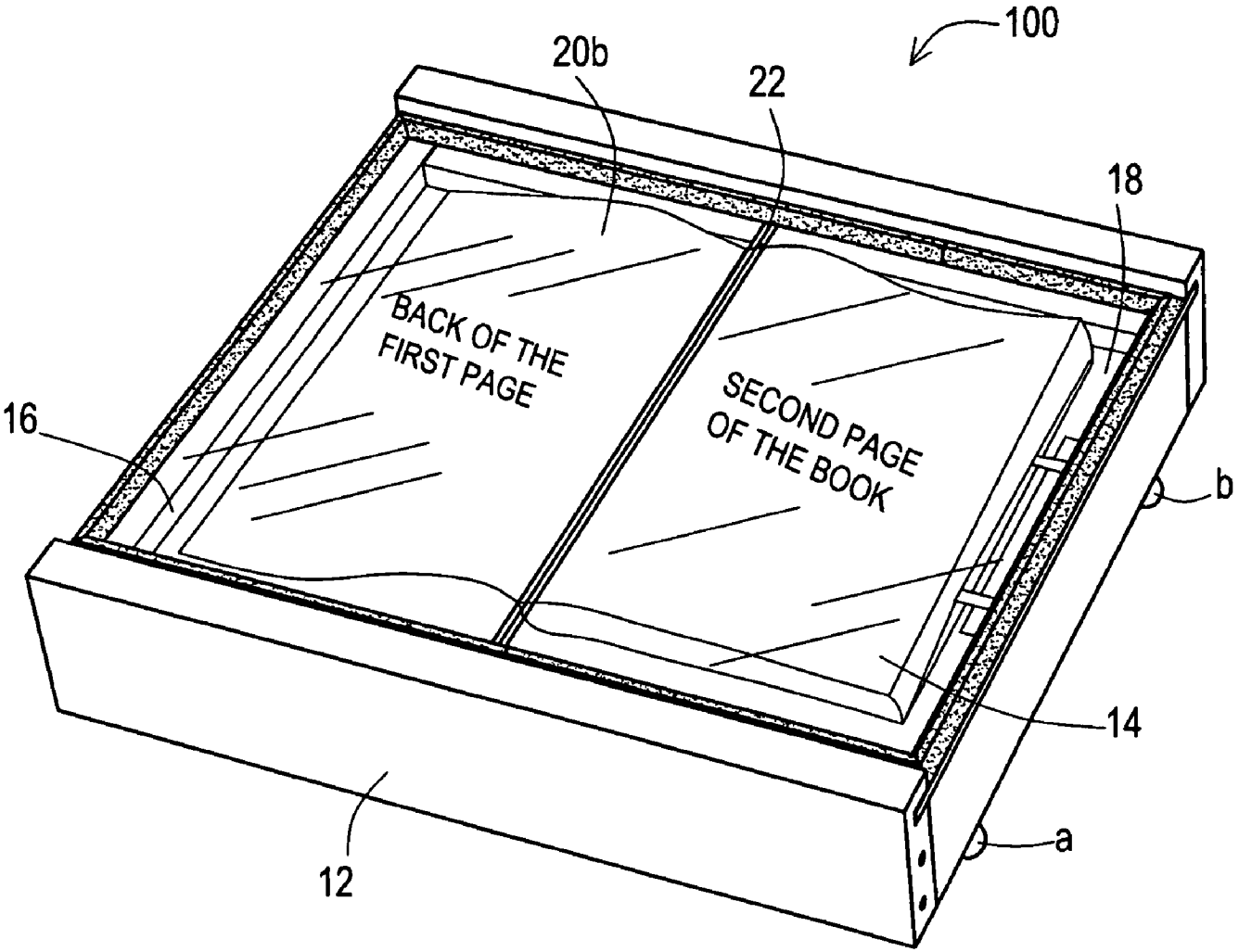
FIG. 10 shows the left and right transparent lids of the box of FIG. 9 moved in the direction of arrow X so the first page is on the left side and the second page is on the right side of the box.

FIG. 10 shows the left and right transparent lids 14 and 16 with spacer gap 22 positioned over the gutter of book 20 and holding the pages in place until the reader decides to turn them. Here, the reader can now read the back of the first page and the front of the second page. Reading additional pages can also be done by repeating the steps outlined above in reference to FIGS. 7-9.

The invention has great applicability to those with arthritis, weak hand grasping capability, and others not able to easily grip books, that may have difficulty physically holding a book, and having to turn a page.

The invention can be used with readers have no hands or arms, where the reader can move the transparent lids with their nose or chin, and move the pages with pursed lips. Additionally, the lids can be also moved with pursed lips.

Figure 11:
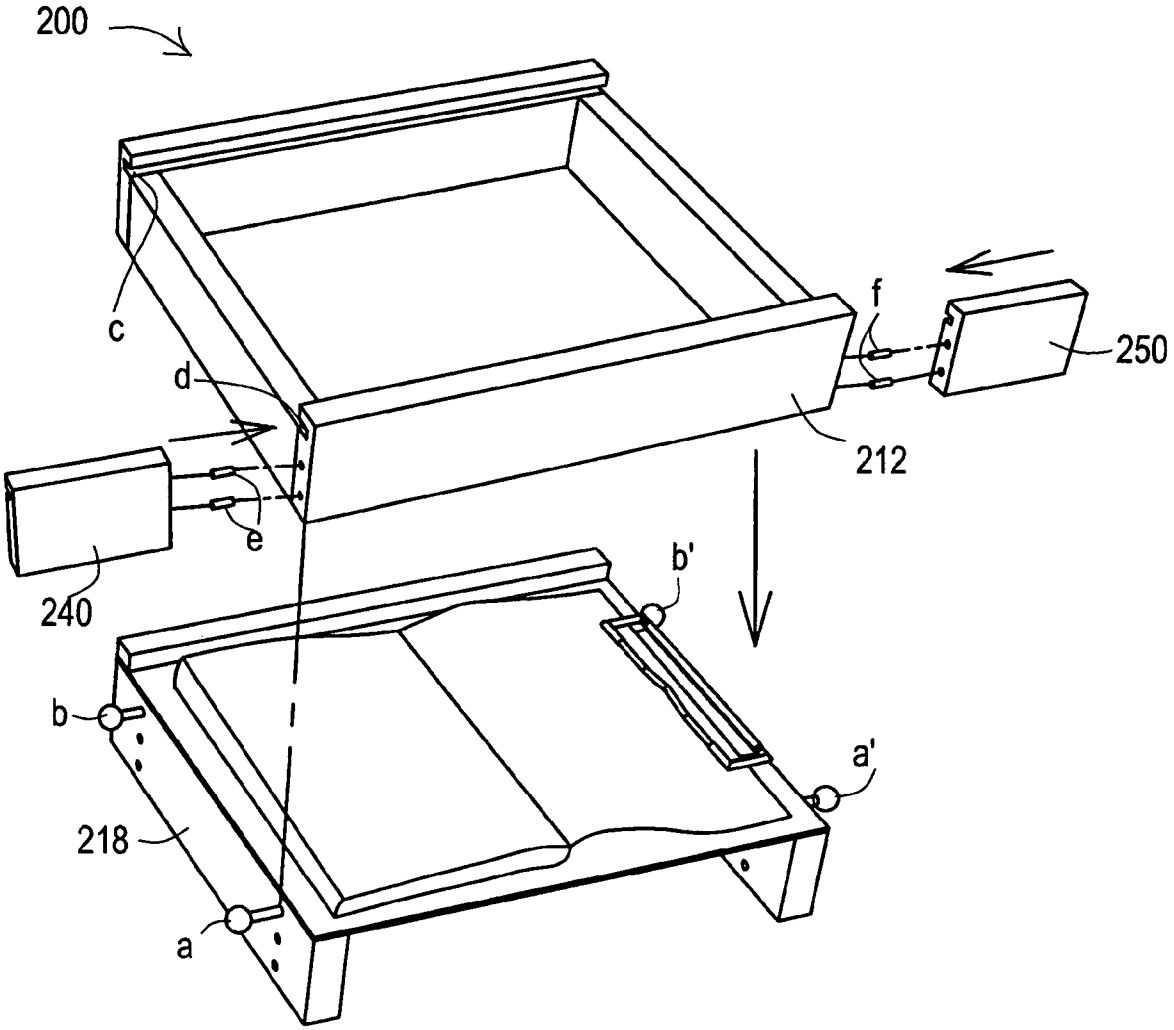
FIG. 11 is an exploded view of another page turning device embodiment of FIG. 5 with wing extensions.

FIG. 11 provides an exploded view of the second embodiment 200 of the door-operated page turning device with platform 218 and bottomless box 212 in position to be fitted over platform 218 and held securely by dowel rods with knobs a,a',b,b' that are slidingly engaged in vertically positioned holes that receive the dowel end of the rod. The new features of the second embodiment are the added wing extensions 240, 250 each with a tongue and groove channel that matches the channels c and d of box 212. The wing extensions 240, 250 are attached to the upper edge of box 212 with dowel inserts e and f. The wing extensions 240, 250 allow for the easy expansion of the range of motion for the transparent lids that open and close in the turning of pages. The wings can support the lids the lids are being moved beyond the right and left sides of the box.

Figure 12:
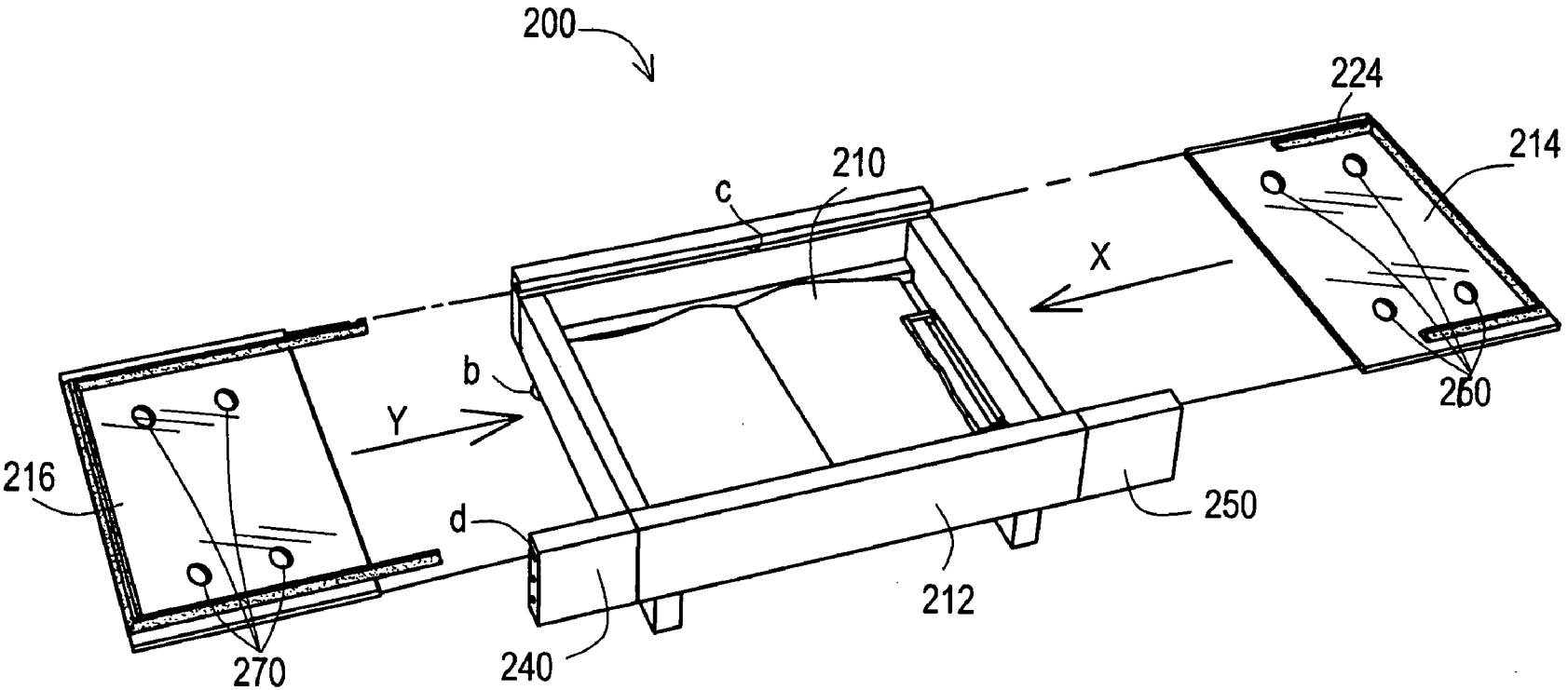
FIG. 12 is another view of the page turning device of FIG. 11 with attached wing extensions and transparent lids separated.

FIG. 12 is a plan view of the door-operated page turning device 200 with wing extensions 240, 250 securely in place and left transparent lid 216 and right transparent lid 214 in position to be moved slidingly along the channels c and d of box 212. Note there are optional openings 260, 270 in the upper and/or bottom portions of each of the transparent lids facilitate the use probe or protruding member with a tip previously described (not shown) to easily open and close the sliding transparent doors. Additionally, the openings 260, 270 allow the use of body parts such as the tip of a reader's nose to more easily move the lids. Furthermore, pursed lips of the reader can also be inserted partially into the openings to allow for moving the lids.

Figure 13:
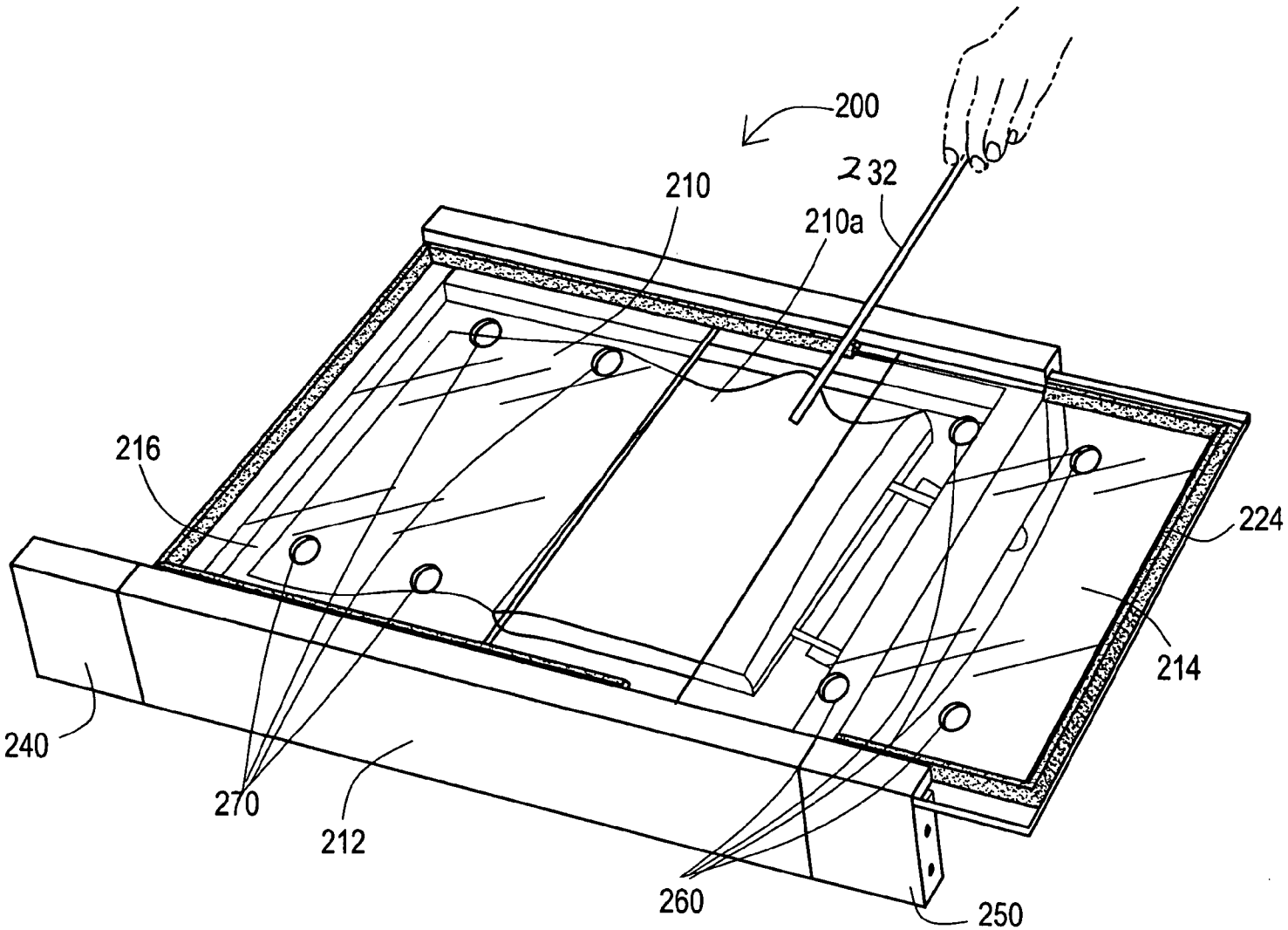
FIG. 13 is another view of the page turning device embodiment of FIG. 11 a first page edge of the platform attached book in the box of the preceding figures, being lifted and raised over the left edge of the right transparent lid.

FIG. 13 shows the door-operated page turning device 200 where the left transparent lid 216 of the door-operated page turning device 200 is in alignment with the left edge of box 212. The right transparent lid 214 of the door-operated page turning device is slidably moved to the right to partially expose a first page 210*a* of book 210. A probe or any protruding member with a tip 232 is used to lift or raise page 210*a* from the stack of pages in book 210. Also, as previously discussed, a body part such as a pursed lips can also be used to move the pages.

Figure 14:
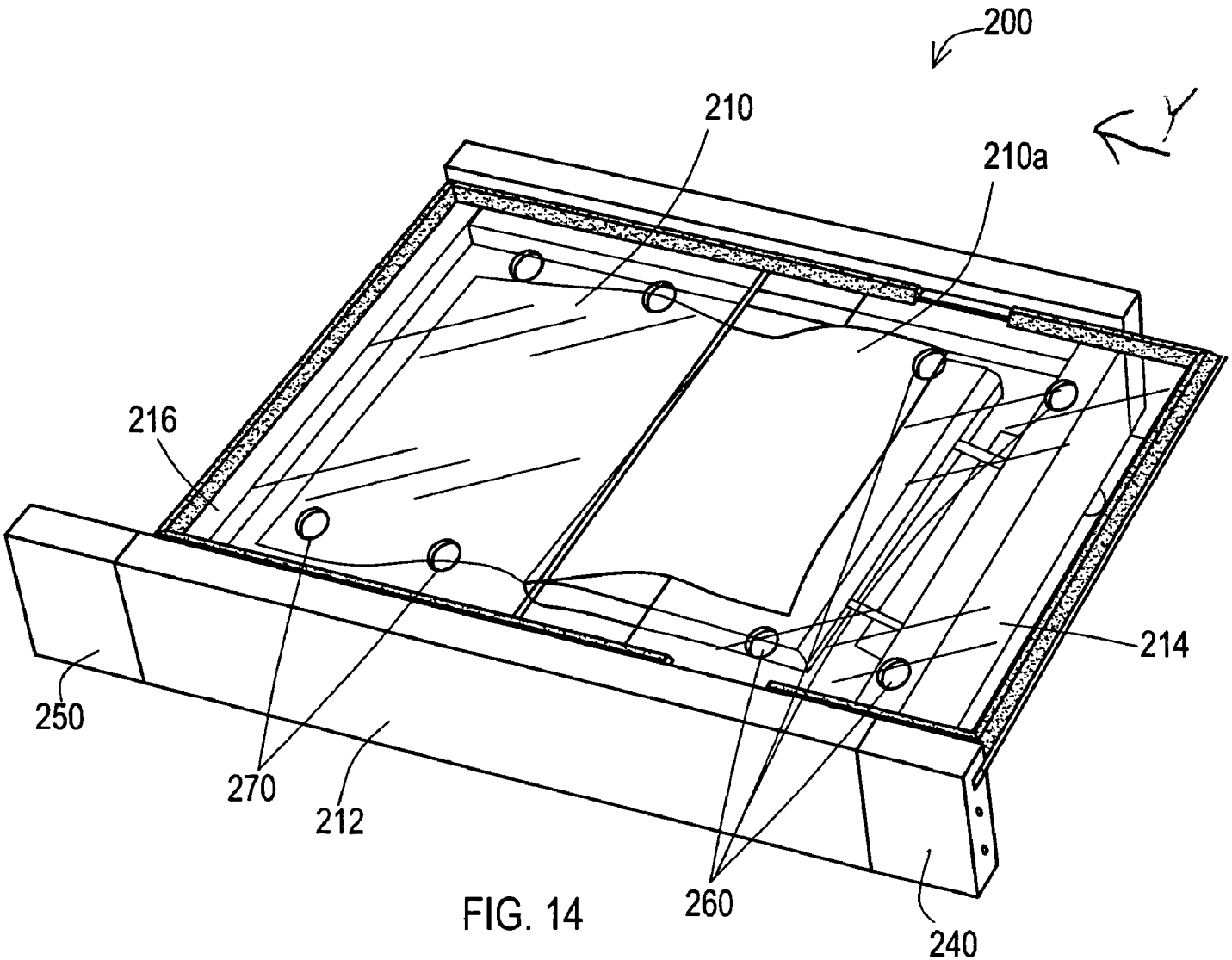
FIG. 14 is another view of the page turning device of FIG. 13 with the right lid being moved to the left along arrow Y to catch under the first page of platform attached book.

The next step for turning a page using the door-operated page turning device is shown in FIG. 14 where a probe or protruding member with a tip 232 is used to guide the outer edge of page 210*a* above an onto the outer surface of the right transparent lid 214. After the user lifts page 210*a* from book 210 using a protruding member with a tip 232, page 210*a* pops up towards the user and the outer edge comes to rest on the outer surface of the right transparent lid 214. Lid of door 214 is slidably moved toward in the direction of arrow Y toward the left transparent lid 216 capturing the page 210*a* in the spacer gap 222 shown in FIG. 15.

Figure 15:
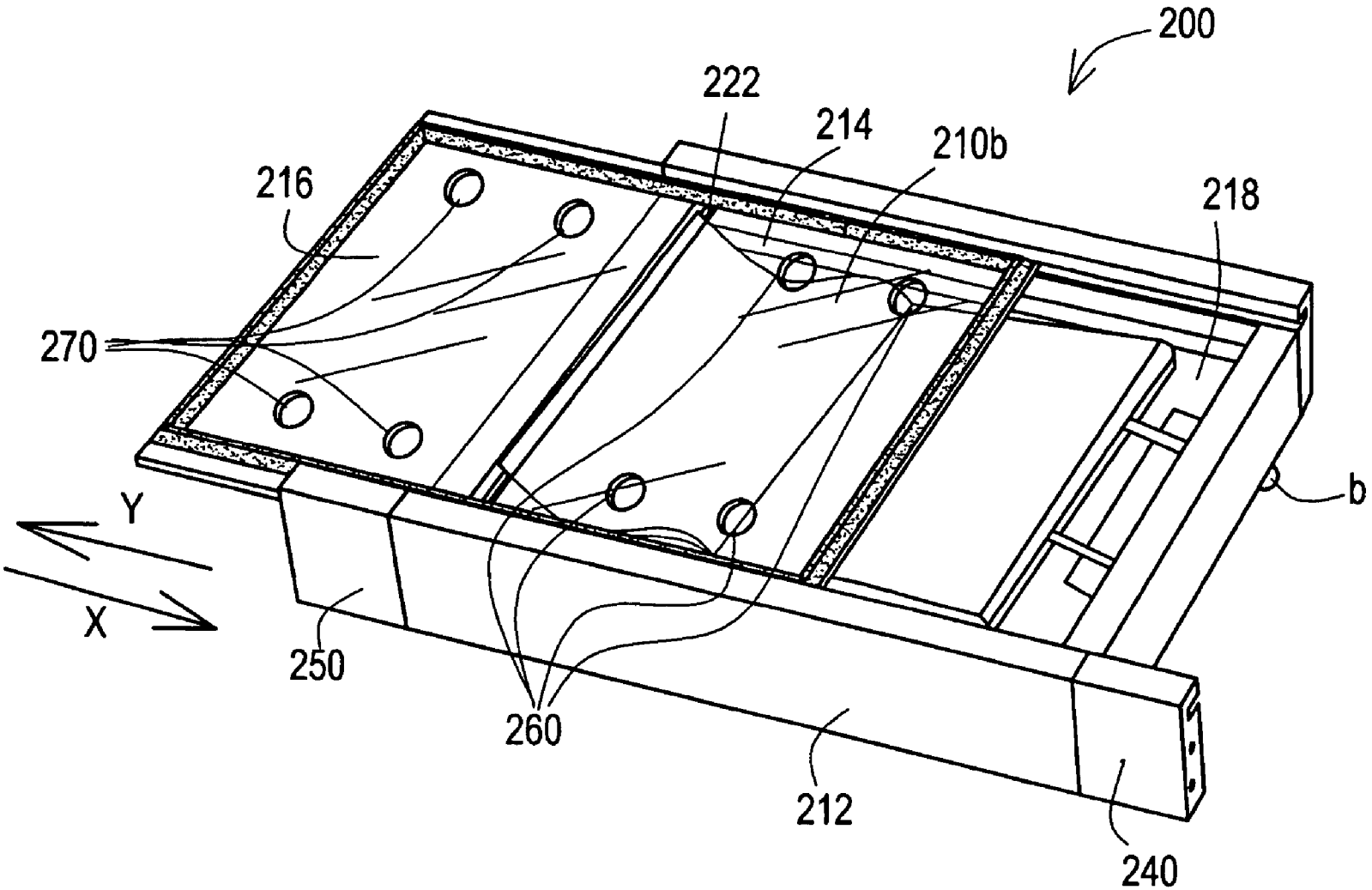
FIG. 15 shows both the left lid and right lid moving in unison to the left along arrow Y, of the page turning device of FIG. 14 with the first page moving from the right side of the box to the left side of the box by slipping through the gap between the left and right transparent lids.

FIG. 15 shows the spacer gap 222 with the page 210*a* sandwiched between the left and right transparent lids and being turned to expose the second page 210*b* of book 210 in a new position overlaying the left side of the flat surface of platform 218. Similar to the previous embodiment the probe 232 can be used to move both the lids to the left.

Figure 16:
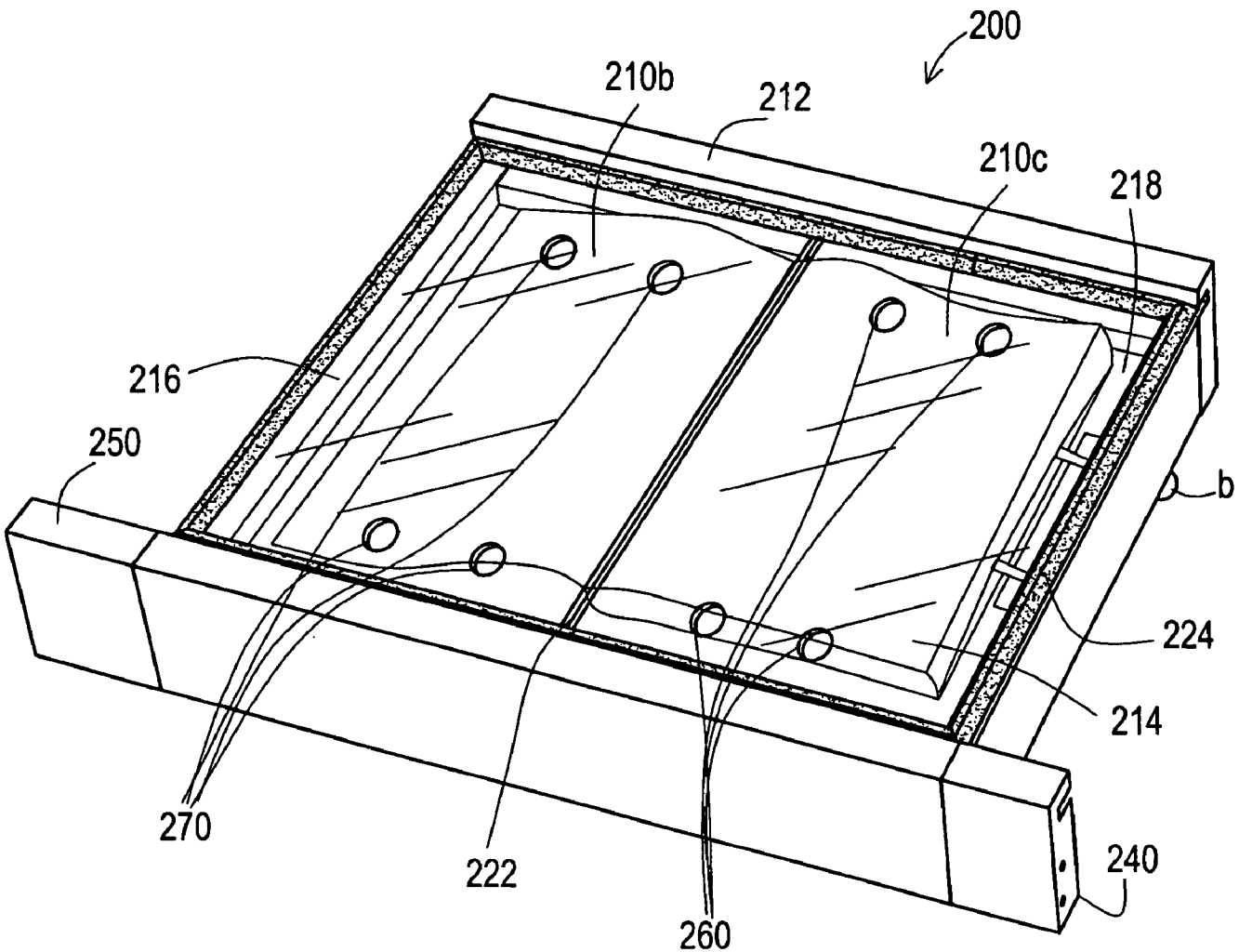
FIG. 16 shows the left and right transparent lids of the box of FIG. 15 moved in the direction of arrow X so the first page is on the left side and the second page is on the right side of the box.
Figure 17:
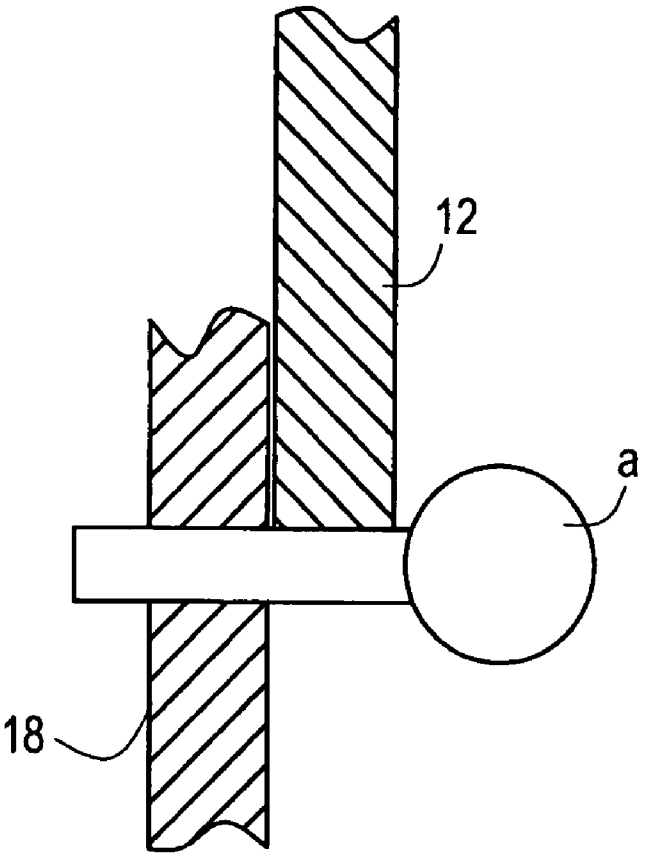
FIG. 17 shows an enlarged side view of the height adjusting knobs of the first embodiment.

FIG. 17 shows the left and right transparent lids 216 and 214 in position after being moved as a single unit in the direction of arrow X of FIG. 16 along the tongue and groove channels c, d of box 212. A protruding member with a tip (not shown) can be used to slidingly move both the left and right transparent lids 214 and 216, respectively, into a position that covers the open surface of box 212, as shown in FIG. 17 where the left and right transparent lids 214 and 216 are covering the turned page 210*b* and the next page 210*c* to be turned by repeating steps shown in FIGS. 13, 14 and 15 above.

Common features of both embodiments of the present invention are now discussed below. Common to both embodiments is a probe or protruding object with a tip for opening and closing the left and right transparent lids and lifting or raising the pages to be turned from a stacked position in a book, magazine or the like. The protruding object with a tip, includes, but is not limited to, a pencil with an eraser tip, and the like. Furthermore, a human body part can be used such as a human nose, human finger, pursed lips, or a prosthetic device used by a handicapped individual.

Another common feature of both embodiments is shown in FIGS. 18 and 19 and is related to the adjustable positioning mechanism used to raise or lower the bottomless box with the sliding transparent lids or doors to accommodate the thickness of a book or other reading material placed on the flat surface of the platform that is covered by the bottomless box. In FIG. 17, a cross-sectional view of platform 18 shows the insertion of dowel rod with a knob a to serve as a support in holding the bottomless box 12 in a selected position. FIG. 18 is a cross-sectional view of the platform 218 that shows the more penetrating insertion of dowel rod with knob a further into the platform 218 so that the bottomless box 212 is raised to a slightly higher position over the platform 218. It is understood that a plurality of dowel rod and knob supports are positioned in appropriate hole positions about the platform to allow the bottomless box to rest squarely and securely on the supports.

While the preferred embodiment shows a spring loaded clamp/clip on the right side of the platform, the invention can also have a spring loaded clamp/clip on the left side of the platform to hold down the front cover page. The invention can also work with both left and right spring loaded clamps. While the spring loaded clamps enhance holding reading material such as paperback books, magazines in place, the invention can be used without the spring loaded clamps for reading material such as hard cover books, and the like.

The present invention provides an easy to manufacture, easy to assemble and easy to use door-operated page turning device for hands-free reading of books of all kinds from hard covered books, mechanical bound books, magazines, sheet music, paperbacks, bound sheets of paper, manuals and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A page turning system for hands-free reading of books comprising in combination:

a box having an open top and sides resting on a bottom surface on a bottom of the box;

a left transparent lid being slidably attached to cover a left portion of the open top;

a right transparent lid being slidably attached to cover a right portion of the open top;

a spacer for keeping the left transparent lid and the right transparent lid spaced apart less than approximately 0.5 inch when the left transparent lid and the right transparent lid are in a closed position covering the open top of the box;

a reading material having a front cover, a back cover and a plurality of stacked reading pages therebetween, the bottom of the box supporting the reading material in an open position with the front cover overlaying a left portion of the flat bottom surface under the box, and the back cover with the plurality of stacked reading pages overlaying a right portion of the flat bottom surface under the box;

a single protruding member with a tip, wherein the tip of the protruding member is adapted to slide the right transparent lid to the right exposing a first page of the stacked reading pages, and the tip is used to lift up an outer edge of the first page to be above the right transparent lid, followed by the tip of the protruding member pushing against and sliding the right transparent lid to slide to the left until the right transparent lid abuts against the spacer, wherein the tip of the protruding member pushes both the closed left and right transparent lids to the left until the raised first page is overlaying the left portion of the bottom of the box.

2. The page turning system of claim 1, wherein the spacer allows for keeping the left transparent lid and the right transparent lid spaced apart approximately ⅛ of an inch when the left transparent lid and the right transparent lid are in a closed position covering the open top of the box.

3. The page turning system of claim 1, wherein the at least one of the left transparent lid and the right transparent lid has a beveled edge that abuts against the spacer.

4. The page turning system of claim 3, wherein the right transparent lid has a beveled edge that abuts against the spacer.

5. The page turning system of claim 1, further comprising:

a left set of tracks for slidably attaching the left transparent lid to the open top of the box; and a right set of tracks for slidably attaching the right transparent lid to the open top of the box.

6. The page turning system of claim 1, further comprising:

height adjustment members for adjusting distance between the left and right transparent lids to the bottom of the box.

7. The page turning system of claim 4, wherein the height adjustment members include:

left lower sides and right lower sides attached to the bottom of the box which slide about the sides of the box; and openings at different heights along the left lower sides and the right lower sides; and dowels for being inserted in the different height openings for separating the left and right transparent lids from the bottom surface under the box for different sizes of reading materials.

8. The page turning system of claim 4, wherein the reading material is a magazine.

9. The page turning system of claim 4, wherein the reading material is a book.

10. The page turning system of claim 1, wherein the protruding member with the tip includes: a pencil with an eraser tip.

11. The page turning system of claim 1, wherein the protruding member with the tip is adapted to be at least one of a human nose, a human finger, and pursed lips.

12. A method for turning pages in a bound volume so that reading is accomplished hands-free, comprising the steps of:

providing a reading material with a front cover, a back cover and a stack of reading pages therebetween;

providing a box having an open top, closed sides and a platform as a bottom of the box;

providing a single protruding member with a tip;

a) opening the reading material so that the front cover is supported on a left portion of the platform and the back cover with the stack of reading pages is supported on a right portion of the platform;

b) slidably covering a left portion of the open top of the box with a left transparent lid;

c) slidably covering a right portion of the open top of the box with a right transparent lid;

spacing the left transparent lid apart from the right transparent lid so that an opening is no greater than approximately 0.5 inch when the left transparent lid and the right transparent lid are in a starting closed position on the top of the box;

d) pressing the tip of the protruding member against a portion of the right transparent lid;

e) slidably moving the right transparent lid to the right with the tip of the protruding member exposing a first page of the stacked reading pages;

f) raising an outer exposed edge of the first page of the stacked reading pages with the tip of the protruding member;

g) allowing the outer exposed edge of the first page to protrude above and come to rest against a portion of the right transparent lid;

h) slidably moving the right transparent lid to the left with the tip of the protruding member until the left transparent lid and the right transparent lid are in a closed position with the first page of the stacked reading pages sandwiched in the opening between the right transparent lid and the left transparent lid;

i) continuing the movement of the right transparent lid to the left until the first page slips through the opening between the closed right transparent lid and left transparent lid and the raised first page is overlaying the left portion of the bottom surface under the box;

j) slidably returning both the closed left and right transparent lids with an opening no greater than approximately 0.5 inch to the starting closed position on the top of the box; and k) repeating above steps a) through j) for exposing each of the additional stacked pages.

13. The method for turning pages of claim 12, wherein the reading material is a magazine.

14. The method for turning pages of claim 12, wherein the reading material is a book.

15. The method for turning pages of claim 12, wherein the single protruding member with the tip includes: a pencil with an eraser tip.

16. The method for turning pages of claim 12, wherein the protruding member with the tip is adapted to be at least one of a human nose, a human finger, and pursed lips.

17. A page turning system for hands-free reading of books comprising in combination:

a box having an open top and sides resting on a bottom surface on a bottom of the box;

a left transparent lid:

a left set of tracks for slidably attaching the left transparent lid to the open top of the box to cover a left portion of the open top;

a right transparent lid;

a right set of tracks for slidably attaching the right transparent lid to the open top of the box to cover a right portion of the open top;

a spacer for keeping the left transparent lid and the right transparent lid spaced apart less than approximately 0.5 inch when the left transparent lid and the right transparent lid are in a closed position covering the open top of the box;

a left wing extension with a tongue and groove channel that attaches and matches the tracks for slidably attaching the left transparent lid to the open top of the left side of the box resting on the bottom surface on the bottom of the box allowing expansion of the range of motion for the left transparent lid to the open top of the box and supporting the left transparent lid when it is moved beyond the left side of the box;

a right wing extension with a tongue and groove channel that attaches and matches the tracks for slidably attaching the right transparent lid to the open top of the right side of the box resting on the bottom surface on the bottom of the box allowing for expansion of the range of motion for the right transparent lid to the open top of the box and supporting the right transparent lid when it is moved beyond the right side of the box;

a reading material having a front cover, a back cover and a plurality of stacked reading pages therebetween, the bottom of the box supporting the reading material in an open position with the front cover overlaying a left portion of the flat bottom surface under the box, and the back cover with the plurality of stacked reading pages overlaying a right portion of the flat bottom surface under the box;

a single protruding member with a tip, wherein the tip of the protruding member is adapted to slide the right transparent lid to the right exposing a first page of the stacked reading pages, and the tip is used to lift up an outer edge of the first page to be above the right transparent lid, followed by the tip of the protruding member pushing against and sliding the right transparent lid to slide to the left until the right transparent lid abuts against the spacer, wherein the tip of the protruding member pushes both the closed left and right transparent lids to the left until the raised first page is overlaying the left portion of the bottom of the box.

18. The page turning system of claim 17, wherein the spacer allows for keeping the left transparent lid and the right transparent lid spaced apart approximately ⅛ of an inch when the left transparent lid and the right transparent lid are in a closed position covering the open top of the box.

19. The page turning system of claim 17, wherein the at least one of the left transparent lid and the right transparent lid has a beveled edge that abuts against the spacer.

20. The page turning system of claim 19, wherein the right transparent lid has a beveled edge that abuts against the spacer.

21. The page turning system of claim 17, further comprising:

height adjustment members for adjusting distance between the left and right transparent lids to the bottom of the box.

22. The page turning system of claim 21, wherein the height adjustment members include:

left lower sides and right lower sides attached to the bottom of the box which slide about the sides of the box; and openings at different heights along the left lower sides and the right lower sides; and dowels for being inserted in the different height openings for separating the left and right transparent lids from the bottom surface under the box for different sizes of reading materials.

23. The page turning system of claim 21, wherein the reading material is a magazine.

24. The page turning system of claim 21, wherein the reading material is a book.

25. The page turning system of claim 17, wherein the protruding member with the tip includes: a pencil with an eraser tip.

26. The page turning system of claim 17, wherein the protruding member with the tip is adapted to be at least one of a human nose, a human finger, and pursed lips.

27. A method for turning pages in a bound volume so that reading is accomplished hands-free, comprising the steps of:

providing a reading material with a front cover, a back cover and a stack of reading pages therebetween;

providing a box having an open top, a closed left side, a closed right side and a platform as a bottom of the box;

providing a left transparent lid to cover a left portion of the open top of the box;

providing a right transparent lid to cover a right portion of the open top of the box;

providing a left wing extension that attaches to the closed left side of the box to allow expansion of the range of motion for the left transparent lid to the open top of the box and support the left transparent lid when it is moved beyond the left side of the box;

providing a right wing extension that attaches to the right side of the box to allow expansion of the range of motion for the right transparent lid to the open top of the box and support the right transparent lid when it is moved beyond the right side of the box;

providing a single protruding member with a tip;

a) opening the reading material so that the front cover is supported on a left portion of the platform and the back cover with the stack of reading pages is supported on a right portion of the platform;

b) slidably covering the left portion of the open top of the box with the left transparent lid;

c) slidably covering the right portion of the open top of the box with the right transparent lid;

d) spacing the left transparent lid apart from the right transparent lid so that an opening is no greater than approximately 0.5 inch when the left transparent lid and the right transparent lid are in a starting closed position on the top of the box;

e) pressing the tip of the protruding member against a portion of the right transparent lid;

f) slidably moving the right transparent lid to the right with the tip of the protruding member exposing a first page of the stacked reading pages;

g) raising an outer exposed edge of the first page of the stacked reading pages with the tip of the protruding member;

h) allowing the outer exposed edge of the first page to protrude above and come to rest against a portion of the right transparent lid;

i) slidably moving the right transparent lid to the left with the tip of the protruding member until the left transparent lid and the right transparent lid are in a closed position with the first page of the stacked reading pages sandwiched in the opening between the right transparent lid and the left transparent lid;

j) continuing the movement of the right transparent lid to the left until the first page slips through the opening between the closed right transparent lid and left transparent lid and the raised first page is overlaying the left portion of the bottom surface under the box;

k) slidably returning both the closed left and right transparent lids with an opening no greater than approximately 0.5 inch to the starting closed position on the top of the box; and l) repeating above steps a) through k) for exposing each of the additional stacked pages.

28. The method for turning pages of claim 27, wherein the reading material is a magazine.

29. The method for turning pages of claim 27, wherein the reading material is a book.

30. The method for turning pages of claim 27, wherein the single protruding member with the tip includes: a pencil with an eraser tip.

31. The method for turning pages of claim 27, wherein the protruding member with the tip is adapted to be at least one of a human nose, a human finger, and pursed lips.

* * * * *